US006109491A

United States Patent [19]

Aronson

[11] Patent Number: 6,109,491

[45] Date of Patent: Aug. 29, 2000

[54] SOCKET RETAINER AND UTILITY BELT FOR USING SAME

[76] Inventor: Gina E. Aronson, 4030-54th St. S., Clinton, Iowa 52732

[21] Appl. No.: 09/268,210

[22] Filed: Mar. 15, 1999

Related U.S. Application Data

[63] Continuation-in-part of application No. 08/992,122, Dec. 17, 1997, Pat. No. 5,893,498.

[51] Int. Cl.[7] ..... A47F 5/00

[52] U.S. Cl. ..... 224/255; 24/3.13; 206/378; 224/271; 224/904

[58] Field of Search ..... 224/255, 256, 224/254, 268, 269, 271, 272, 904; 206/493, 377, 378, 379; 24/3.6, 3.11, 3.12, 616, 3.13

[56] References Cited

U.S. PATENT DOCUMENTS

| | | | |
|---|---|---|---|
| 1,797,098 | 3/1931 | Minehart | 224/268 |
| 2,775,804 | 1/1957 | Ayoub | 24/3.6 |
| 3,886,773 | 6/1975 | McGahee . | |
| 4,226,105 | 10/1980 | Wehrman | 70/456 R |
| 4,422,315 | 12/1983 | Klose | 71/456 R |
| 4,765,470 | 8/1988 | Curci . | |
| 4,923,105 | 5/1990 | Snyder . | |
| 4,930,628 | 6/1990 | Bridges . | |
| 4,957,231 | 9/1990 | Kalisher | 224/268 |
| 5,108,287 | 4/1992 | Yee et al. . | |
| 5,139,144 | 8/1992 | Robert, Jr. . | |
| 5,203,469 | 4/1993 | Chang et al. . | |
| 5,326,068 | 7/1994 | Spears . | |
| 5,341,975 | 8/1994 | Marinescu . | |
| 5,429,289 | 7/1995 | Lamson et al. | 224/269 |
| 5,511,705 | 4/1996 | Dreszer . | |
| 5,512,165 | 4/1996 | Liu . | |
| 5,573,116 | 11/1996 | Zink . | |
| 5,687,892 | 11/1997 | Johns | 224/268 |
| 5,743,394 | 4/1998 | Martin . | |

FOREIGN PATENT DOCUMENTS

| | | | |
|---|---|---|---|
| 0095593 | 7/1983 | Germany | 24/3.6 |

*Primary Examiner*—Gregory M. Vidovich
*Assistant Examiner*—Maerena N. Brevard
*Attorney, Agent, or Firm*—Leydig, Voit & Mayer, Ltd.

[57] ABSTRACT

A socket retainer and utility belt for using same to allow maintenance or construction personnel to quickly identify and gain access to a particularly sized socket. The present invention provides a socket retainer, preferably adapted to be worn on a utility belt, wherein a plurality of socket retainers are strung from the utility belt, with each socket retainer being adapted to hold a particular socket. Each socket retainer includes a mechanism for retaining a socket thereon, and a mechanism for releasing a socket therefrom when it is so desired by the worker. As opposed to prior art systems, the present system increases the efficiency of the worker in that less time is required for searching for the socket of interest.

12 Claims, 5 Drawing Sheets

SOCKET RETAINER AND UTILITY BELT FOR USING SAME

CROSS-REFERENCE TO RELATED APPLICATION

This application is a continuation-in-part of U.S. patent application Ser. No. 08/992,122, filed on Dec. 17, 1997, now U.S. Pat. No. 5,893,498.

FIELD OF THE INVENTION

The present invention generally relates to hand tools, and more particularly relates to means for individually retaining sockets for easy access by users.

BACKGROUND OF THE INVENTION

Sockets, socket sets, and socket wrenches are common types of hand tools which are used by various maintenance and construction personnel to facilitate attachment and detachment of nuts and bolts typically having hexagonal heads. Depending upon the size of the hexagonal head, an appropriately sized socket will be used to attach to the head for rotation thereof. The actual rotation can be generated either by hand using a wrench, ratchet, or otherwise, or with a power tool which generates the force necessary for rotation. Such sockets can be manufactured to correspond to shapes other than conventional hexagonal heads, and in addition, can be sized to accommodate both the U.S. and metric standards of measurement.

If a particular user of such a socket set is located or positioned such that an entire tool box or socket set can be made available for ready access to the variously sized sockets, various trays and holding mechanisms can be used to display the sockets in descending or ascending order according to size to allow the user to quickly identify and grasp the socket of interest. U.S. Pat. No. 5,573,116 discloses such a tray which displays variously sized sockets for access by a user.

However, certain maintenance and construction personnel are required to be mobile and as a result are limited in the quantity of tools which can be carried about the work site. Various means have therefore been developed to allow a worker to carry certain specifically defined tools through the use of a utility belt or the like. For example, U.S. Pat. No. 5,512,165 discloses a personal tool box which can be attached to a utility belt and, through the use of a plurality of shelves, can pivot about a portion of the tool box to allow the user to access variously sized tools including sockets. However, such a system is bulky and prone to inadvertent disengagement of the tools and sockets from the tool box.

Alternatively, a loop or strand of cable or wire can be formed to allow for the sockets to be strung end-to-end on the loop with a means being provided to close the loop to retain the sockets thereon. U.S. Pat. No. 5,139,144 discloses such a system wherein the loop can be carried about by the user. However, since the sockets are strung end-to-end on the loop, unless the socket of interest is the one closest to the end of the loop, a number of sockets will necessarily have to be removed to allow access to the socket of interest, which in turn will require the undesired sockets to be restrung upon the loop after the desired socket is removed. This necessarily results in a slow and frustrating process.

The problems indicated above especially manifest themselves when the maintenance or construction worker is required to act quickly, and therefore does not have the luxury of removing a number of sockets strung end-to-end upon a loop, or searching through a number of different compartments to find the socket of interest. For example, a maintenance worker required to keep a production machine on-line quite often has to make quick decisions for quick repairs which therefore requires that the worker not waste time in searching for the tool required for the given job. A system which would allow the worker to gain quick identification and access of the tool or socket of interest would therefore result in a more efficient worker, and ultimately in lower cost of maintenance or manufacture in the product or system with which the worker is associated.

Moreover, it would be advantageous to provide such a socket retaining mechanism in a manner and form which is inexpensive to manufacture and maintain.

SUMMARY OF THE INVENTION

It is an objective of the present invention to provide a mechanism by which sockets can be individually retained by a mobile maintenance or construction worker as he or she moves about a work site.

It is an objective of the present invention to provide a utility belt to be worn by construction or maintenance personnel which allows for easy identification and access of the particular socket of interest.

It is another objective of the present invention to provide a socket retaining system which decreases the time necessary for identification and access of the socket of interest.

It is yet another feature of the present invention to provide a socket retaining mechanism which includes a reliable system for retaining the individual sockets on the socket retainer as well as reliably detaching the sockets therefrom.

In accordance with these aims and objectives, it is a feature of the present invention to provide a socket retainer comprising a base arm including a first end and a second end, a belt retention ring proximate the first end of the base arm, and a locking arm proximate the second end of the base arm and movable between a retention position wherein the locking arm is parallel to the base arm, and a release position wherein the locking arm is non-parallel to the base arm, and means for attaching the socket retaining mechanism to a utility belt.

It is another feature of a preferred embodiment of the present invention to provide a socket retainer comprising a base arm having a first end and a second end, a retention ring at the first end of the base arm and a locking arm having a retention nib integrally molded to the base arm at the second end, the locking arm and retention nib adapted to move inwardly relative to the base arm to change the width of the socket retainer for release or insertion of a socket.

It is another feature of a preferred embodiment of the present invention to provide a socket retaining utility belt comprising a belt adapted to be worn by a worker, a loop of linear material or releasably attached to the belt, and a plurality socket retainers attached to the loop of linear material, each socket retainer including a base arm having a first end and a second end, an aperture at the first end for attachment of the retainer to the loop of linear material, and a locking arm at the second end, the locking arm being elastically deformable toward the base arm and including a retention nib for engagement with a socket.

It is another feature of the preferred embodiment of the present invention to provide an integrally molded structure having a base and a deformable arm adapted to move inwardly to reduce the width of the structure to facilitate insertion and release of a socket, and to move outwardly to increase the width of the structure to retain a socket.

These and other objectives and features of the invention will become more apparent from the following detailed description when taken in conjunction with the accompanying drawings.

Figure 1:
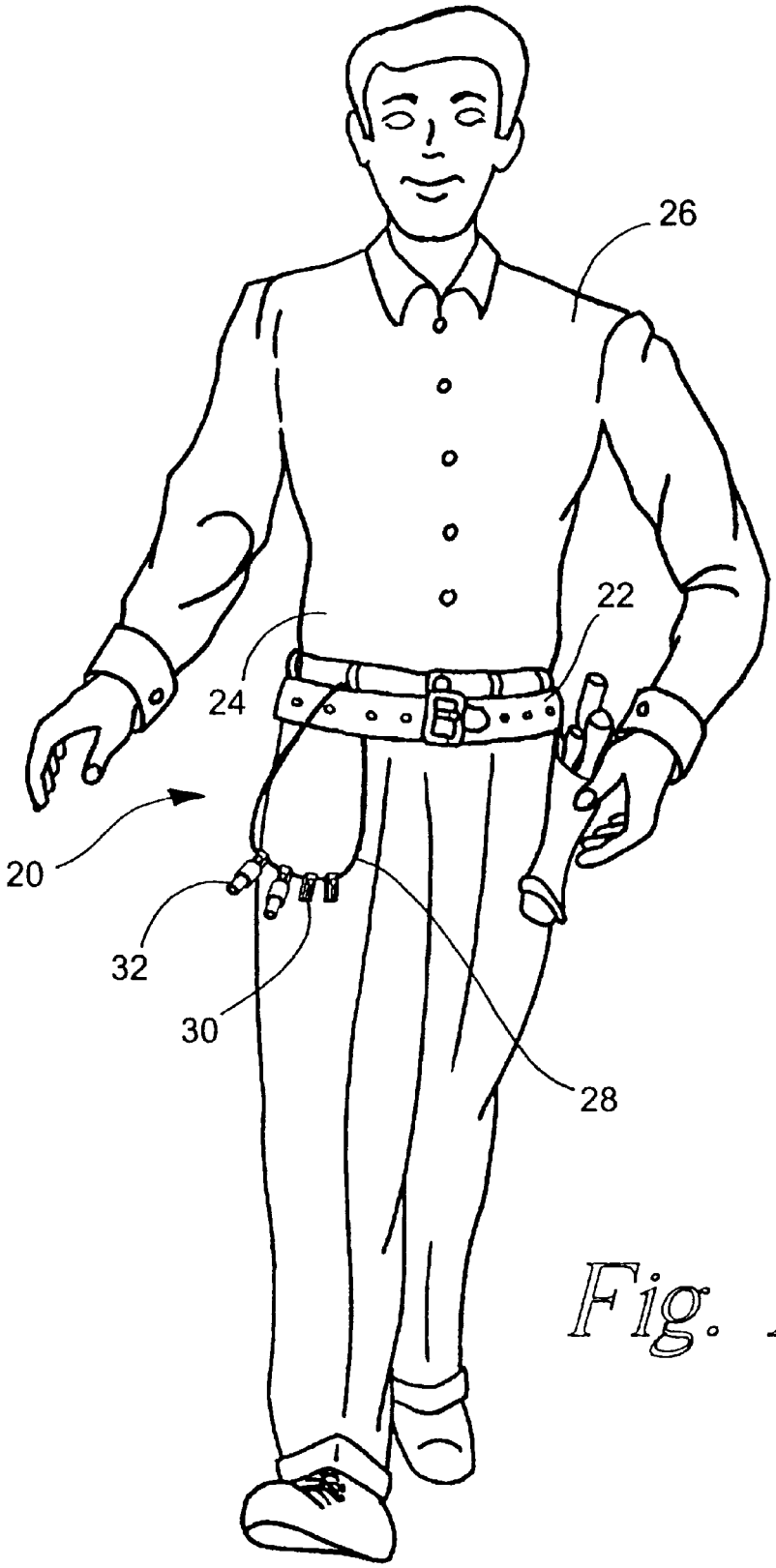
FIG. 1 is a perspective view of a preferred embodiment of the present invention as worn by a typical user.

While the present invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, a first preferred embodiment of the present invention is shown as socket retaining system 20. As shown therein, system 20 is preferably adapted to be worn in the form of a utility belt 22 about the waist 24 of the worker 26. As discussed above, a variety of means have been developed to allow a worker to carry variously sized sockets about a given job site, but each requires a substantial investment of time in searching for the particular socket of interest, as well as allowing access to the particular socket of interest. In stark contrast to such prior art devices, the present invention provides a system by which a worker who is required to be mobile about a job site to carry sockets about the job site in an organized fashion to allow the worker to quickly identify and gain access to the particular socket of interest.

In this preferred form, such objectives are obtained by providing a strand of wire 28 which is fastened to utility belt 22. In alternative embodiments, strand of wire 28 can in fact be strung about the entire waist 24 of worker 26 in lieu of utility belt 22. However, in the preferred embodiment of the present invention strand of wire 28 is attached to an existing utility belt 22 to allow the user to carry tools in addition to sockets along with utility belt 22.

As shown in FIG. 1, a plurality of socket retainers 30 are strung on wire 28 in side-by-side fashion. Sockets 32 of varying size can be strung from retainers 30 typically in descending or ascending order, to allow the user to quickly identify the socket of interest. Sockets 32, as is conventional, include one opening corresponding to the size of the given nut or bolt, and at another opening having a standard size for attachment to a socket wrench or drill. The size of socket retainers 30 therefore correspond to the size of the socket opening adapted to be attached to a socket wrench.

Figure 2:
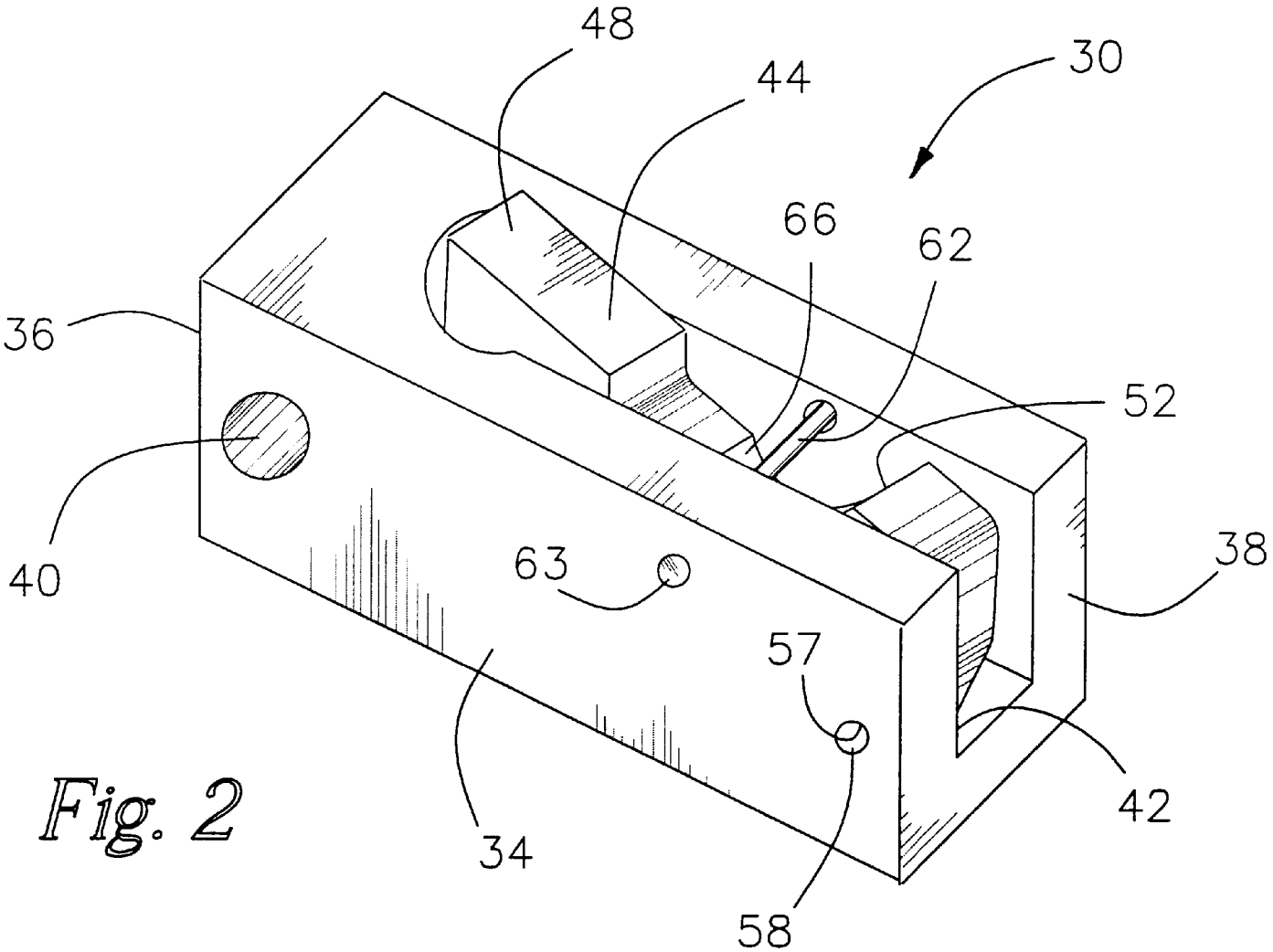
FIG. 2 is an enlarged perspective view of an individual socket retainer.
Figure 4:
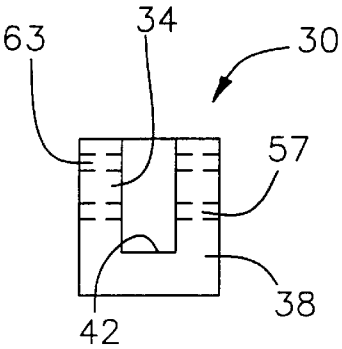
FIG. 4 is a end view of the socket retainer shown in FIG. 3.
Figure 6:
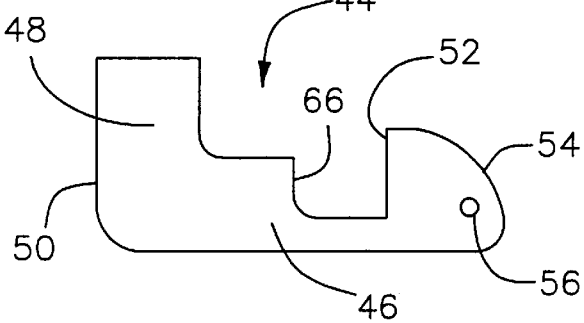
FIG. 6 is a plan view of the lever arm.

Referring now to FIG. 2, socket retainers 30 are shown in greater detail as primarily comprised of an elongate body 34 having first end 36 and second end 38. First end 36 is provided with aperture 40 which is sized to accommodate strand 28 and thereby allow socket retainer 30 to be strung from utility belt 22. Second end 38 on the other hand, as best shown in FIG. 4, includes a channel 42 which runs from second end 38 the length of elongate body 34 to approximately the position of aperture 40. Channel 42 is provided to accommodate lever arm 44 therein. As best shown in FIG. 6, lever arm 44 also includes a substantially elongated body 46 having head 48 at first end 50 and lip 52 at second end 54. It can also be seen that second end 54 includes aperture 56 and elongate body 34 includes apertures 57 through which pivot 58 passes to attach lever arm 44 to elongated body 34. Pivot 58 therefore allows lever arm 44 to be rotatably attached to elongated body 34.

Figure 3:
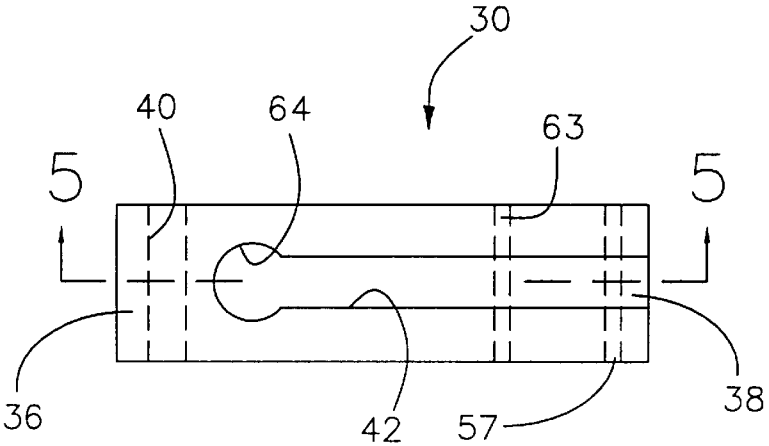
FIG. 3 is a top view of the socket retainer shown in FIG. 2, without the lever arm, spring, and lock bar.
Figure 5:
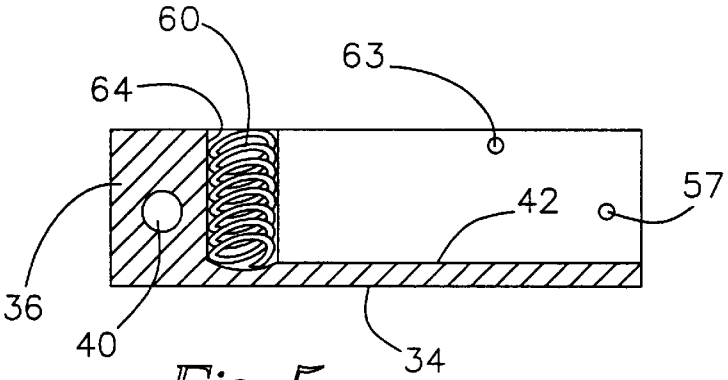
FIG. 5 is a sectional view of the socket retainer taken along line 5—5 of FIG. 2, with the spring included.

The actual position of lever arm 44 within elongated body 34 is dictated by the opposing forces of spring 60 and lock bar 62. As best shown in FIGS. 3 and 5, spring 60 is provided within cylindrical recess 64 and is so situated to correspond to head 48 of lever arm 44. Under normal operating conditions, spring 60 exerts an outward force against lever arm 44 which forces head 48 to protrude from channel 42. In addition, the outward force of spring 60 causes lip 52 of lever arm 44 to also protrude from channel 42, the importance and function of which will be described in greater detail herein. In order to retain lever arm 44 within channel 42, and not allow spring 60 to force lever arm 44 completely out of channel 42, lock bar 62 is attached to elongated body 34 through apertures 63 and spans across channel 42 as best shown in FIG. 3. Lever arm 44 includes a recess 66 which is adapted to receive lock bar 62 when spring 60 is able to force lever arm into the normal operating position.

With regard to the interaction of socket retainers 30 with individual sockets 32, it can be seen that when spring 60 is able to force lever arm 44 from channel 42, lip 52 protrudes from channel 42 as well. It can also be seen that elongated body 34 includes a square cross-section (see FIG. 4) sized accordingly to be received within an aperture of socket 32. The outward force of spring 60 forces lip 52 to engage socket 32 and retain socket 32 thereto. Specifically, lip 52 engages a shoulder positioned radially outward from the aperture of socket 32.

When it is desired by the worker to release socket 32 from socket retainer 30, he or she is able to depress head 48 of lever arm 44 into channel 42 and thereby force lip 52 of lever arm 44 into channel 42. This in turn causes lip 52 to move out of engagement with the shoulder of socket 32 to allow the user to pull socket 32 from elongated body 34 for useful work.

After the worker has completed the job requiring a given socket 32, the socket 32 can be reattached to the elongated body 34 in a reverse fashion such that the force of socket 32 being received on elongated body 34 causes lip 52 of lever arm 44 to be forced into channel 42. Once socket 32 is forced onto elongated body to a position such that the shoulder moves past lip 52, spring 60 will force lever arm 44, and accordingly lip 52, to protrude from channel 42 and again engage the shoulder of socket 32 for attachment of socket 32 to socket retainer 30.

Figure 7:
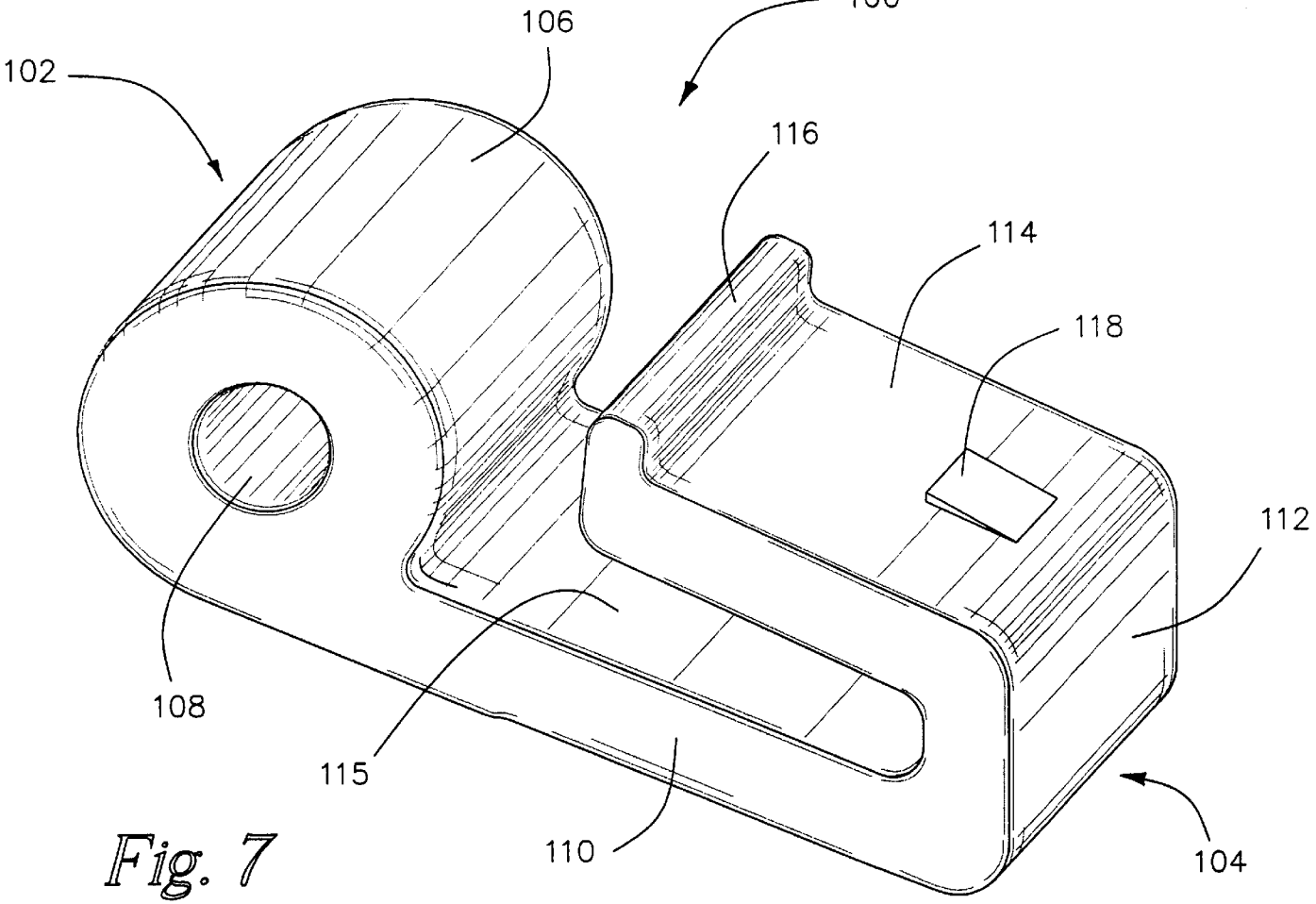
FIG. 7 is a perspective view of a second preferred embodiment of the present invention.
Figure 8:
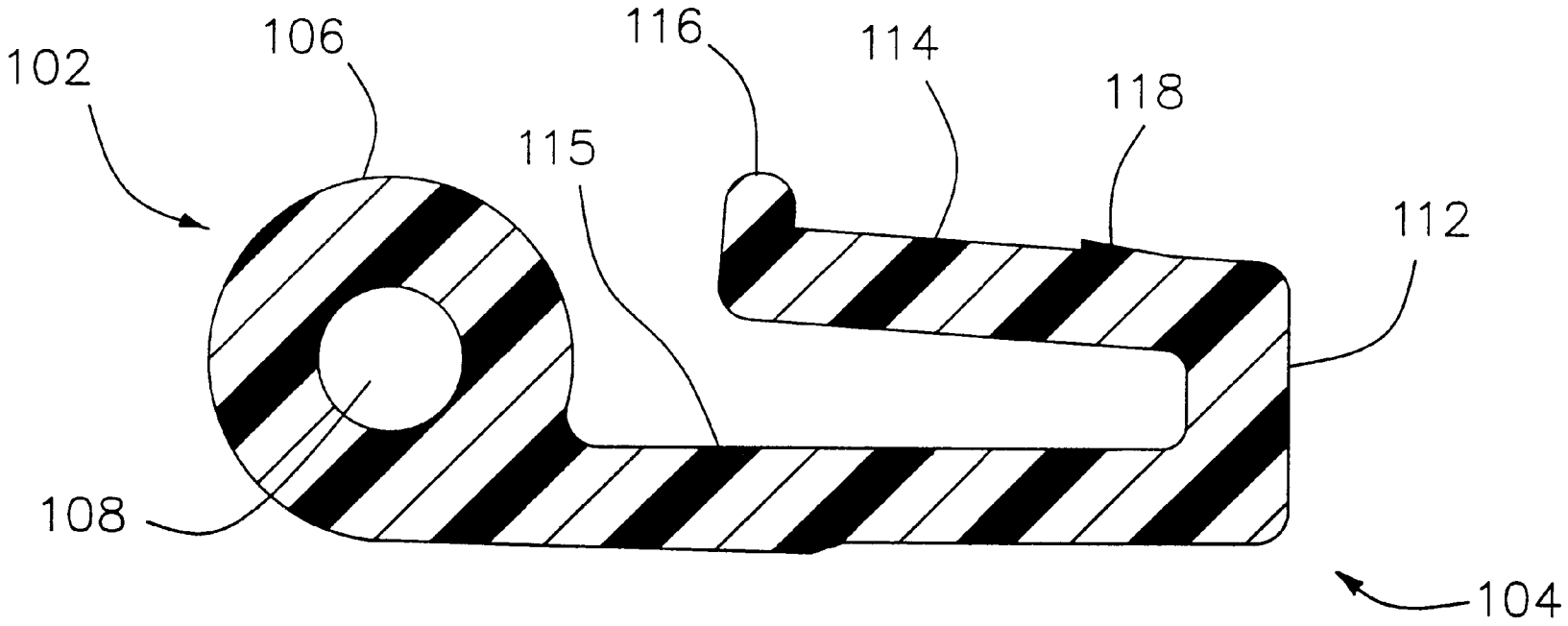
FIG. 8 is a sectional view of the alternative embodiment with the release position shown in phantom lines.

Referring now to FIGS. 7 and 8, a second preferred embodiment of the present invention is depicted as socket retainer 100. As shown therein, retainer 100 is formed as an integrally molded structure, preferably plastic, but it is to be understood that it could be fabricated from multiple pieces of different materials forming the same structure. However, plastic materials provide relatively low cost, low weight and an inherent elasticity, the importance of which will be described in detail later herein.

More specifically, retainer 100 includes first end 102, as well as second end 104. First end 102 includes annular ring 106 forming aperture 108 through which a strand of wire 28 can be strung for attachment to a utility belt 22 as previously described. In lieu of wire 28, any linear material can be used with similar efficacy.

However, rather than use a spring biased metal lever to releaseably retain a socket to retention end 102, this embodiment includes a base arm 110 of reduced depth, hinge arm 112 extending from base arm 110, as well as locking arm 114 extending from hinge arm 112. Given the elastic properties of the plastic material from which the retainer 100 is fabricated as well as the aforementioned structure, locking arm 114 can be elastically deformed inwardly into valley 115 for attachment and release purposes with respect to socket 32.

To facilitate this process, it can be seen from FIG. 7 that locking arm 114 includes stopping, ledge 116 to provide a positive stop to socket 32, as well as an identifiable tab for the user to depress when removing a socket. In other words, the user can depress locking arm 114 inwardly to thereby reduce the width of the structure and remove nib 118 from engagement with a shoulder of socket 32. This action thereby allows socket 32 to be removed. It can therefore be seen that locking arm 114 is moveable between first and second positions. The first position, or locking position, is achieved naturally when no external forces act inwardly on locking arm 114. In so doing, locking arm 114 is parallel to base arm 110, and nib 118 is in position to engage a socket received on retainer 100. In the second position, or release position, the user manually forces locking arm inwardly to be non-parallel to base arm 110. Nib 118 is thereby disengaged from the socket to enable its release. In addition, it is shown that locking arm 114 includes retention nib 118 to engage socket 32 for retention purposes.

As opposed to prior art systems, it can therefore be seen that the present invention provides a new and improved system which allows a user to quickly identify and gain access to the particular socket and socket size of interest. Moreover, the system allows the user to quickly detach the socket of interest from the utility belt and then easily reattach the socket once its use is no longer required. Not only does such a system provide for greater efficiency, but is also less cumbersome and weighty than prior art systems which require an entire tool box, in essence, to be carried about with the worker.

What is claimed is:

1. A socket retainer for mounting a socket thereto, said socket being a hand tool, the socket retainer comprising:

a base arm having a first end and a second end;

the first end of the base arm defining a belt retention aperture;

a locking arm having a first end and a second end, the second end of the locking arm connected to the base arm proximate the second end of the base arm to define a valley between the locking arm and base arm, the base and locking arms being relatively deflectable to reduce the size of the valley;

the locking arm including a positive stop proximate the first end and a retention nib having a shape and position arranged to engage a socket when mounted to the socket retainer, wherein the locking arm is substantially parallel to the base arm when the interior cavity of a socket is inserted onto both the locking arm and base arm.

2. The socket retainer of claim 1 further including a hinge arm connecting the base arm and locking arm.

3. The socket retainer of claim 1 wherein the retainer is formed of plastic and the base arm, locking arm, hinge arm, positive stop and retention nib are integrally molded together.

4. A socket retainer for mounting a socket thereto, said socket being a hand tool, the socket retainer comprising:

a base arm having a first end and a second end;

the first end of the base arm defining a retention aperture; and a locking arm connected to the base arm proximate the second end to define a valley between the locking arm and base arm, the locking arm having a retention nib having a shape and position arranged to engage a socket when mounted to the socket retainer by said base arm and said locking arm being received in a cavity of the socket; wherein the base and locking arms being relatively deflectable to reduce the size of the valley for disengagement of the nib from the socket.

5. The socket retainer of claim 4 wherein the socket retainer is formed from integrally molded plastic.

6. The socket retainer of claim 5 wherein the first end of the base arm is formed in the shape of a ring.

7. The socket retainer of claim 5 further including a hinge arm connecting the base arm to the locking arm.

8. A socket retaining utility belt for retaining hand tool sockets thereon, the socket retaining utility belt comprising:

a belt adapted to be worn by a worker;

a loop of linear material releaseably attached to the belt;

a plurality of socket retainers attached to the loop of linear material, each socket retainer including a base arm having a first end and a second end, the first end defining an aperture for attachment of the retainer to the loop of linear material, and a locking arm connected to the base arm proximate the second end, the locking arm including a retention nib for engagement with a socket, the base arm and the locking arm defining a cross-section of each socket retainer sized to be received by a socket.

9. The socket retaining utility belt of claim 8 wherein each socket retainer is formed from integrally molded plastic.

10. The socket retaining utility belt of claim 9 wherein each socket retainer further includes a hinge arm connecting the base arm and locking arm.

11. The socket retaining utility belt of claim 8, wherein the base and locking arms define a valley therebetween and are relatively deflectable to reduce the size of the valley for disengagement of the retention nib and a socket.

12. The socket retainer of claim 1, wherein the base and locking arms are relatively deflectable to reduce the size of the valley for disengagement of the retention nib and a socket.

* * * * *